US008636625B2

(12) United States Patent
Johnson

(10) Patent No.: US 8,636,625 B2
(45) Date of Patent: Jan. 28, 2014

(54) ALL IN ONE FITNESS BALL

(76) Inventor: Carl Wayne Johnson, Spring, TX (US)

( * ) Notice: Subject to any disclaimer, the term of this patent is extended or adjusted under 35 U.S.C. 154(b) by 355 days.

(21) Appl. No.: 12/969,985

(22) Filed: Dec. 16, 2010

(65) Prior Publication Data

US 2012/0157270 A1 Jun. 21, 2012

(51) Int. Cl.
*A63B 23/14* (2006.01)

(52) U.S. Cl.
USPC ..... 482/45; 482/44; 482/46; 482/50

(58) Field of Classification Search
USPC ..... 482/44–50, 92, 93, 136, 137, 148; 434/247
See application file for complete search history.

(56) References Cited

U.S. PATENT DOCUMENTS

| | | | | |
|---|---|---|---|---|
| 5,242,348 | A | 9/1993 | Bates | |
| 5,800,311 | A * | 9/1998 | Chuang | 482/44 |
| 6,387,022 | B1 | 5/2002 | Smith | |
| 6,773,377 | B1 * | 8/2004 | Yu et al. | 482/45 |
| 2001/0001094 | A1 | 5/2001 | Panes | |
| 2012/0302407 | A1 * | 11/2012 | Kelliher | 482/45 |

* cited by examiner

*Primary Examiner* — Glenn Richman
(74) *Attorney, Agent, or Firm* — Gordon G. Waggett, P.C.

(57) ABSTRACT

A new weighted exercise ball is disclosed in the present invention. The ball has handles on each side of the ball which rotate 360 degrees clockwise or counter clockwise. The handles alleviate stress on the wrists and provide a firm grip. The ball has inner compartments that slide outward and allows for the entry of weights of various sizes.

7 Claims, 6 Drawing Sheets

ALL IN ONE FITNESS BALL

BACKGROUND OF THE INVENTION

Medicine ball training is one of the oldest forms of strength training. One of the earliest forms of the medicine ball is found in Persia nearly 3000 years ago and Ancient Greece. These early forms were made from animal skins stuffed with sand. These early medicine balls were used for strength and conditioning training, and injury prevention and rehabilitation. Medicine balls are stilled for these purposes today, but the structure of the medicine ball has evolved.

Medicine balls are constructed of nylon cloth which is covered with leather or vinyl. They are filled with an impact absorbing material which gives them their weight. Some medicine balls are made of rubbery material and consist of having an inner rubber bladder covered with an outer rubber shell. These types of medicine balls are used in exercises where bouncing is required.

Also, medicine balls can have variations on the outside structure of the ball. Typically, a medicine ball is a spherical form which is the ball and nothing more. However, various manufactures have been incorporating the use of handles on or into the ball. Some balls have one handle while others have two with one on each side. Handles allow the user to grasp and swing the ball which alleviates strain on the wrists. Some balls incorporate a rope which passed through the center of the ball and is knotted on the end. This allows the user to swing the ball with little strain. Other balls incorporate a bar that also passes through the center of the ball, so the ball is placed in the center of the bar.

Medicine balls provide various ways to facilitate functional strength training. Instead of focusing on only one muscle group, exercises utilizing the medicine ball make the trainee, use multiple muscle groups at once. One main exercise use of medicine balls is to improve core strength. The core of the human body relates to the abdominals, lower back, hips and spine. The medicine ball can also be used to improve stability, upper and lower body strength.

Medicine balls can also be used for rehabilitation after an injury. Rehabilitative exercises with a medicine ball will improve joint integrity and strengthen the muscles with light resistance.

SUMMARY OF THE INVENTION

The present invention provides a new structure to the medicine ball. In the preferred embodiment of the present invention, the weighted ball can have a predetermined diameter of at least 33 inches. However, the diameter of the ball can vary from small, medium or large to accommodate user. The All In One Fitness Weight Ball can be constructed of soft plastic, rubbery and metal materials. It has handles on each side of the ball which rotate 360 degrees clockwise or counter clockwise. The handles alleviate stress on the wrists and provide a firm grip. An innovative feature of the present invention is the removable weights. The weights are fitted over a metal shaft that is positioned within the interior of the ball structure. The metal shaft is attached into to one of the handles and is positioned into the interior of the ball which is hollow. One particular handle has a pushbutton on it, so that when the button is depressed the handle and metal shaft become removable to allow for the insertion of weights. The All In One Fitness Weight Ball uses weights that start at two pounds, but can vary in weight.

DETAILED DESCRIPTION

Figures 1, 1A, 1B, 1C:
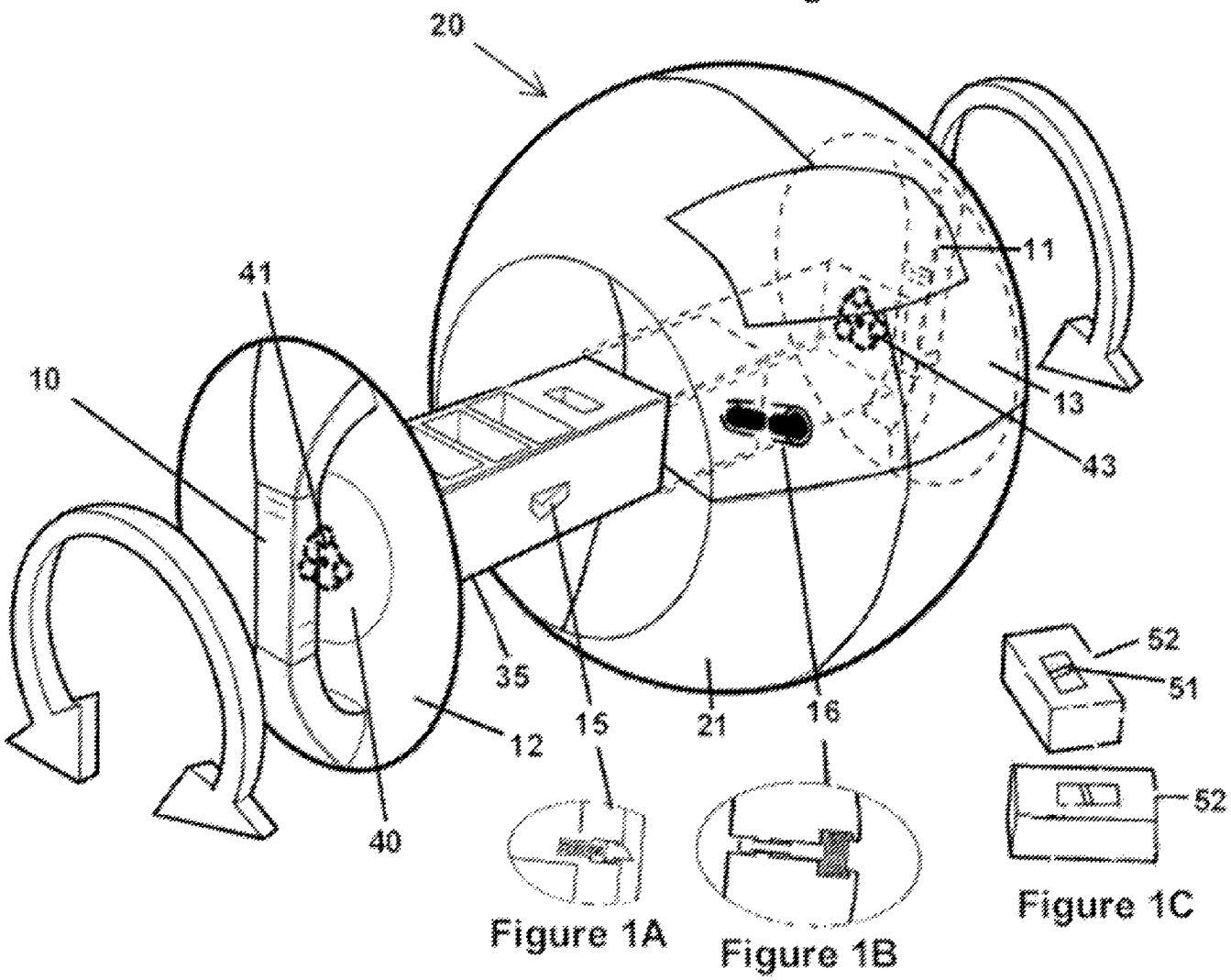
FIG. 1 is an exploded perspective view of the present invention with shaft removed.
FIG. 1A is a cutaway view of the spring-loaded button.
FIG. 1B is a cutaway view
FIG. 1C is a cutaway view of the weights.

Referring now to the drawings, especially FIG. 1, there is illustrated an exploded perspective view of one embodiment the present invention. In the preferred embodiment, the fitness ball (20) consists of a geometrical structure (21) that is hollow internally. In the preferred embodiment, the geometrical structure (21) is spherical. However, the geometrical shape of structure (21) is not limited. The structure (21) further comprises opposing covers (12, 13) at each end. In the depicted embodiment, each cover (12, 13) is circular in nature and has a recessed section (40, 42) in the center. Handles (10, 11) are attached to each cover (12, 13). As shown, each handle (10, 11) arcs over the recession section (40, 42) within each cover (12, 13) and attach at the sides of the covers (12, 13). Each end of the handles (10, 11) is fixably attached to each side of the covers (12, 13).

Figure 2:
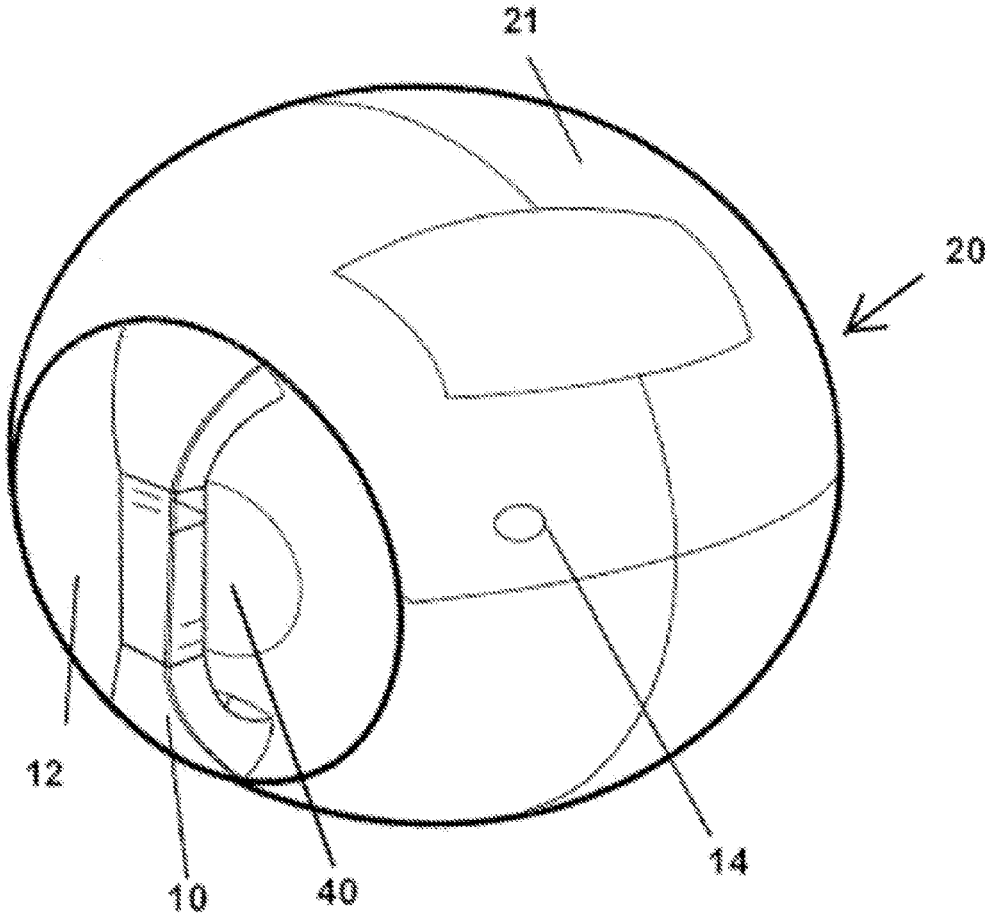
FIG. 2 is a perspective view of the medicine ball the shaft in place.

A unique feature of the present invention depicted in FIG. 2 is the push button (14) which allows the user to change the weight of the fitness ball (20). In operation, a push button (14) is operationally connected within the geometrical structure (21) as illustrated in FIG. 2. Referring to FIGS. 1A and 1B, when the button (14) is depressed, it triggers a spring-loaded button (15) internally disposed within the structure (21) that is attached to the shaft (35). As shown in FIG. 1A, the spring-loaded button (15) on the shaft (35) depresses into a hole (16) in the shaft (35) which allows it to lie flat against the interior wall of the geometrical structure (21). This process unlocks the shaft (35) which is slidably engaged within the structure (21) and allows the user to remove the shaft (35). When the user slides the shaft (35) into the structure (21), the spring-loaded button (15) will go into the hole (16) and lie flat. Once the shaft (35) is in place, the spring-loaded button (15) fits into a hole (16) in the interior wall. This process allows the shaft (35) to lock in place as shown in FIG. 1.

Figure 3B:
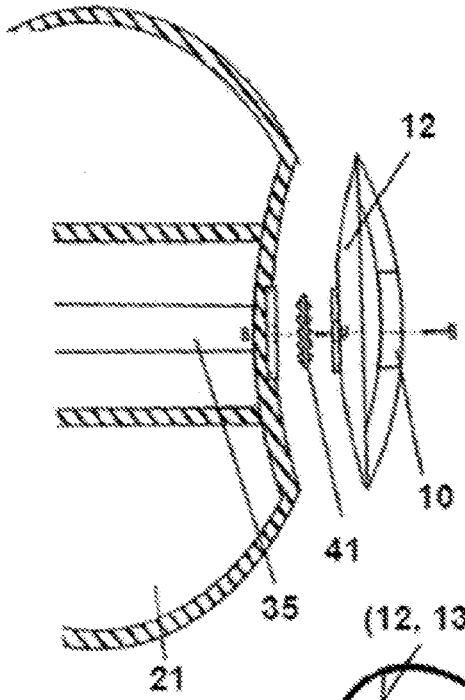
FIG. 3B is a side view of the cover and placement of ball bearing.
Figure 3A:
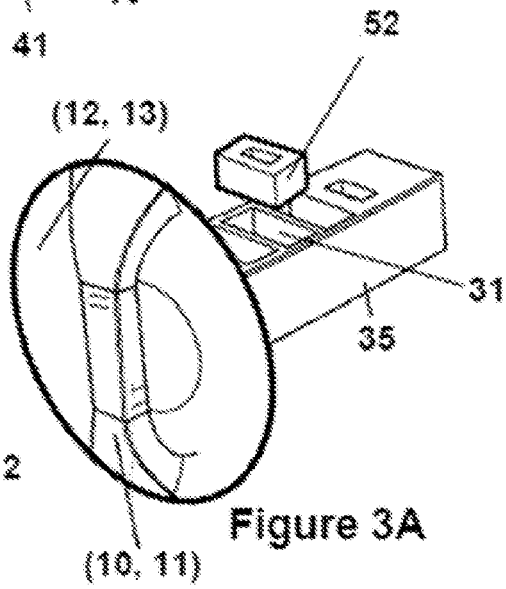
FIG. 3A is a perspective view of the shaft.
Figure 3:
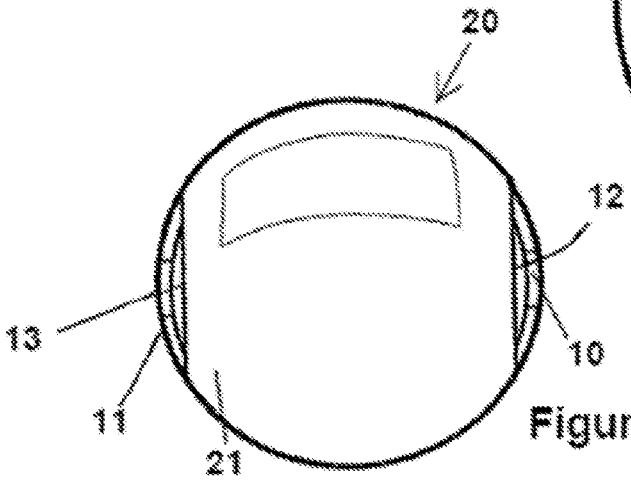
FIG. 3 is a side view of the present invention.
Figure 4:
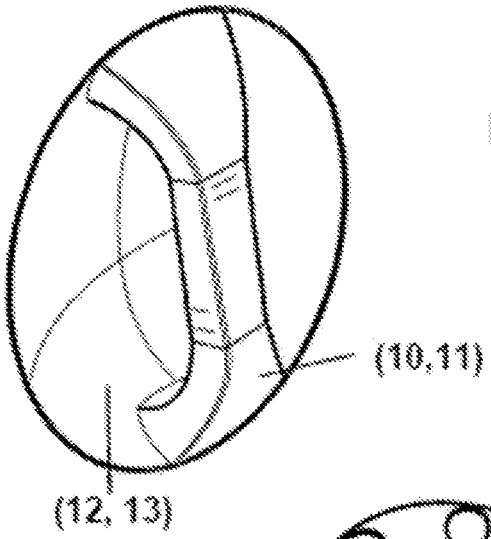
FIG. 4 is a perspective view of the handle.
Figure 5A:
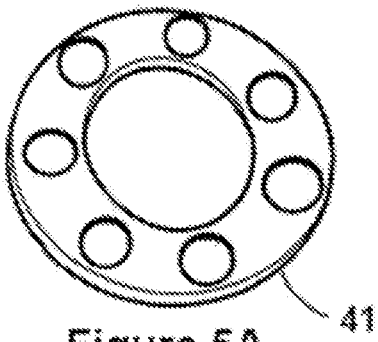
FIG. 5A is a perspective view of the ball bearing.
Figure 5B:
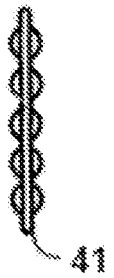
FIG. 5B is a side view of FIG. 5A.
Figure 6A:
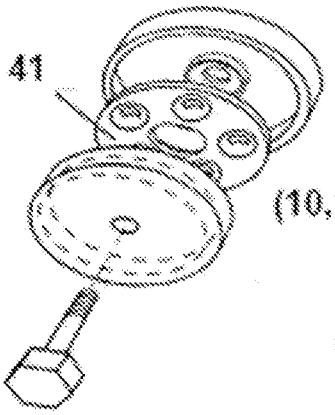
FIG. 6A is an exploded view of ball bearing.
Figure 6B:
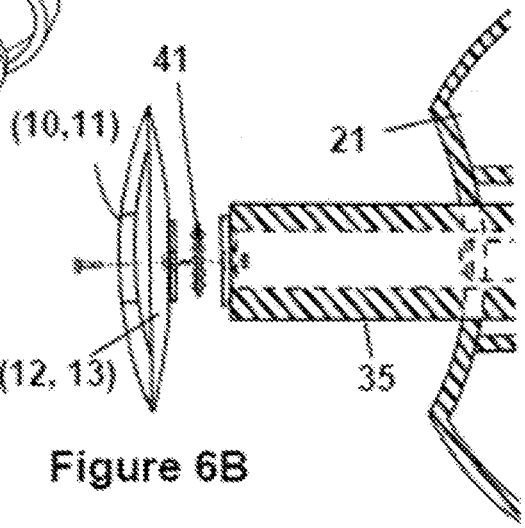
FIG. 6B is a cross-sectional view of the cover.

FIG. 3 shows the shaft (35) locked in place. Referring to FIG. 3A, the internal shaft (35) is illustrated. The shaft (35) is attached to opposing removable covers (12, 13) and therefore is removable from the structure (21). In the preferred embodiment, the shaft (35) is rectangular in structure and contains a plurality of compartments (31) aligned along the longitudinal axis of the shaft (35). Each compartment (31) is a recessed area into the shaft (35). The compartments (31) allow the trainee to place weights (52) of various sizes into the shaft (35). This allows the trainee to control the weight of the fitness ball (20).

FIG. 1C illustrates one embodiment of weights (52) that accompany the fitness ball (20). The weights (52) are rectangular in structure and have a centrally disposed depression within the upper surface area of the weight (52). The weights (52) are designed to sit within the compartments (31) inside the shaft (35) as shown in FIG. 1.

Figure 8:
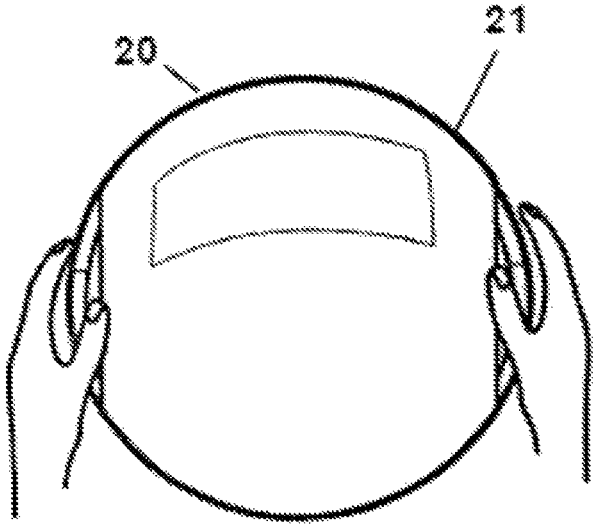
FIG. 8 is a cut away view of the hand placement on the device.
Figure 8A:
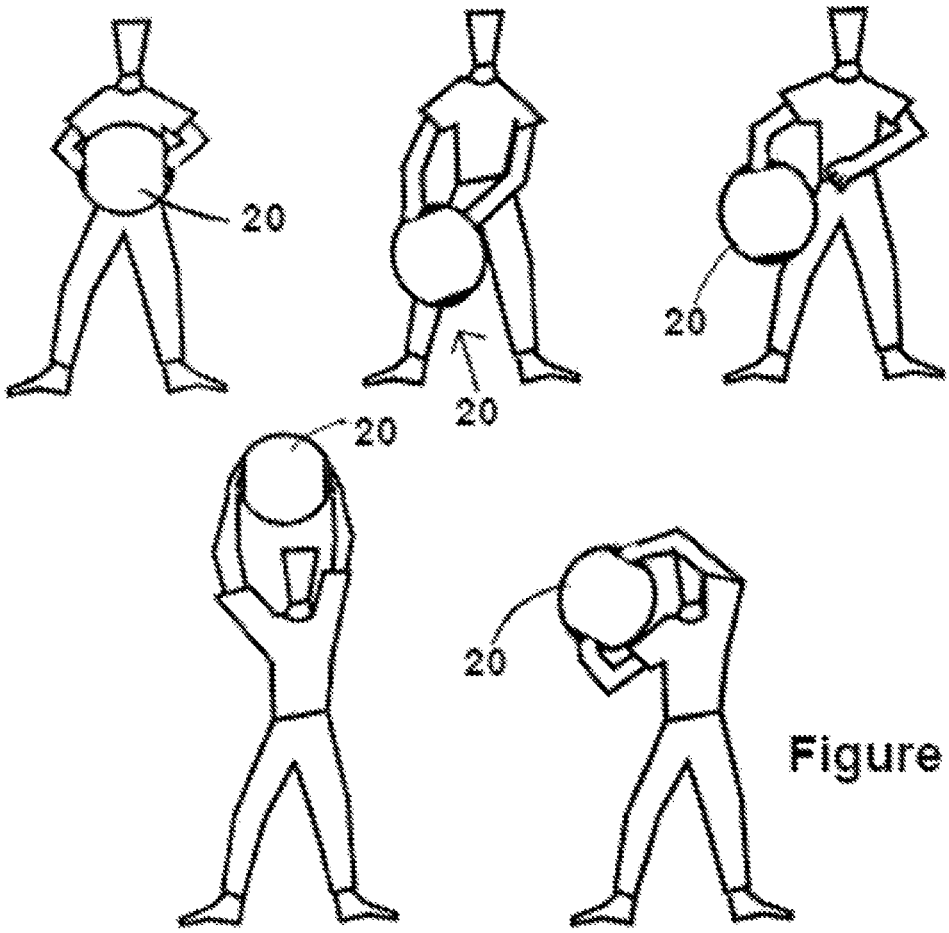
FIG. 8A is an operational view of various poses.

Referring to FIGS. 5A, 5B, 6A and 6B, the ball bearings (41, 43) that allow the fitness ball (20) to independently rotate is illustrated and are disposed within cover (12, 13). Each cover (12, 13) can independently rotate 360 degrees. Opposing ball bearings (41, 43) are disposed between the handles (10, 11) on the opposing sides of the shaft (35). In operation as shown in FIGS. 8 and 8A, the user grasp the handles (10, 11), and he can rotate the fitness ball (20) by turning the handles (10, 11). The ball bearings (41, 43) facilitate the rotation of the fitness ball (20) while decreasing friction.

Figure 7:
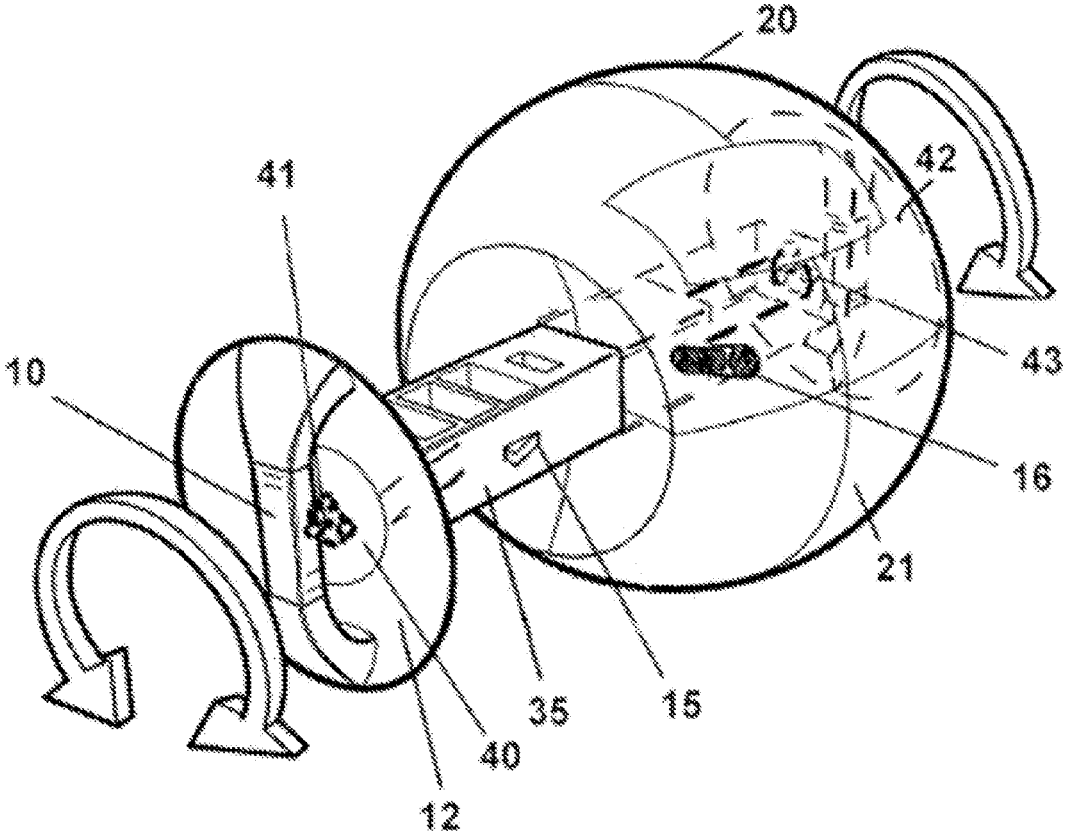
FIG. 7 is a perspective view of an alternative embodiment of the fitness ball with the rod for stabilization.
Figure 7A:
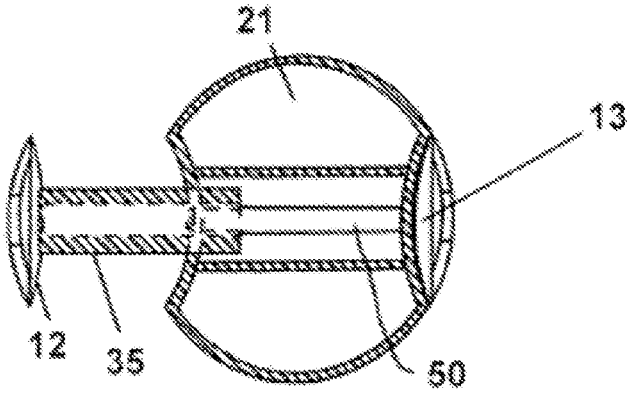
FIG. 7A is a cross-sectional view of the invention.
Figure 7B:
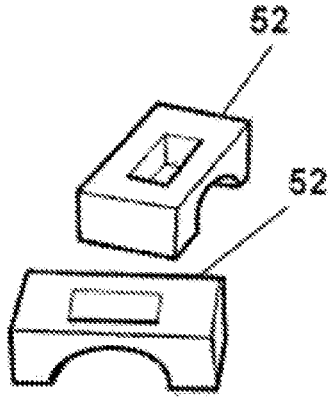
FIG. 7B is the cut away view of the weight.

Referring to FIGS. 7, 7A, and 7B, an alternative embodiment of the present invention is illustrated. A rod (50) is provided to stabilize the fitness ball (20) specifically when larger weights (52) are used. The rod (50) is tubular in structure and is permanently attached to cover (13). In the alternative embodiment, the interior shaft (35) is still included, but has some modifications. In the alternative embodiment, the shaft (35) is modified to slide over and engage with the rod (50). The underside of the shaft (35) has an arc which allows the shaft (35) to engage with the rod (50). FIG. 7B illustrates the underside of each weight (52) also has an arc, so it can fit into the modified shaft (35). The weights (52) have a rectangular depression on the top, and a handle (51) is attached to the depression. The handle (51) allows the user to pick the weight (52) up. Handle (51) can also be used in the weights in FIG. 1 as illustrated in FIG. 1C.

What is claimed:

1. An athletic apparatus comprising:

a geometrical structure having an interior area with a first removable cover and an opposing and in parallel relation second removable cover, the first cover and the opposing second cover being independently rotationally mounted to the geometric structure, handles being attached to an outer surface area of the first and second cover, the geometrical structure having an internal chamber centrally disposed within the interior area of the structure, the internal chamber slidably receiving a shaft member, a plurality of compartments disposed along a longitudinal axis of the shaft member, each compartment having an aperture configured to receive a weight of a predetermine amount;

a pushbutton located on an exterior surface area of the structure being operationally connected through the interior area of the structure to the shaft member wherein depression of the pushbutton causes the shaft member to be released from the internal chamber.

2. The apparatus of claim 1 wherein the geometrical structure is spherical.

3. The apparatus of claim 1 wherein the first and second handle cover further comprises a recessed portion directly below the handle forming a gripping area for a hand of a user.

4. The apparatus of claim 1 wherein the pushbutton is operationally connected to a spring-loaded button located on the shaft member such that when pushed, a spring-loaded button located on the shaft member recedes into a hole which allows the shaft to be removed, the spring-loaded button is designed to fit into a hole on the interior wall of the structure which locks the shaft into place.

5. The apparatus of claim 1 wherein each weight is adapted with a handle disposed over a small recessed area along the top surface of each weight wherein the weight can be lifted from the compartment.

6. The apparatus of claim 1 wherein each weight can independently vary in weight amount.

7. An athletic apparatus comprising:

a geometrical structure with a first removable cover and an opposing second removable cover, the first cover and the opposing second cover being independently rotationally mounted to the geometric structure, handles being attached to an outer surface area of the first and second cover, the structure having an internal chamber which slidably receives a shaft member with an arc located within an underside portion along the longitudinal axis, a plurality of compartments disposed along a longitudinal axis of the shaft member, each compartment having a cavity configured to receive a weight;

a rod extending between the first cover and the opposing second cover and is affixed there to, the arc having a recessed portion configured to seat upon the rod wherein the structure is stabilized.

* * * * *